US006315947B1

(12) United States Patent
Sircar

(10) Patent No.: US 6,315,947 B1
(45) Date of Patent: Nov. 13, 2001

(54) FREE-MACHINING ALUMINUM ALLOY AND METHOD OF USE

(75) Inventor: Subhasish Sircar, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 09/576,897

(22) Filed: May 23, 2000

(51) Int. Cl.[7] ..... C22C 21/00
(52) U.S. Cl. ..... 420/536; 420/554
(58) Field of Search ..... 420/536, 554

(56) References Cited

U.S. PATENT DOCUMENTS

| | | |
|---|---|---|
| 3,753,695 | 8/1973 | Lloyd . |
| 4,005,243 | 1/1977 | Baba et al. . |
| 4,244,756 | 1/1981 | Tanabe et al. . |
| 4,471,032 | 9/1984 | Fukuoka et al. . |
| 4,590,133 | 5/1986 | Lloyd . |
| 4,617,172 | 10/1986 | Mori . |
| 4,747,889 | 5/1988 | Nishio et al. . |
| 4,957,822 | 9/1990 | Steeg et al. . |
| 5,122,208 | 6/1992 | Alabi . |
| 5,282,909 | 2/1994 | Ara et al. . |
| 5,286,445 | 2/1994 | Kamiya . |
| 5,375,760 | 12/1994 | Doko . |
| 5,511,603 | 4/1996 | Brown et al. . |
| 5,522,950 | 6/1996 | Bartges et al. . |
| 5,525,294 | 6/1996 | Tanaka et al. . |
| 5,573,608 | 11/1996 | Miyake et al. . |
| 5,580,402 | 12/1996 | Fujita et al. . |
| 5,587,029 | 12/1996 | Sircar . |
| 5,593,082 | 1/1997 | Ivanov et al. . |
| 5,725,694 | 3/1998 | Sircar . |
| 5,744,255 | 4/1998 | Doko et al. . |
| 5,771,965 | 6/1998 | Inaba et al. . |

OTHER PUBLICATIONS

Spillard, Ultralloy® 6020: A Lead Free Aluminum Alloy featuring "A" Rated Machinability, publisication, pp. 61–68. No year data.

*Primary Examiner*—Roy King
*Assistant Examiner*—Janelle Combs-Morillo

(57) ABSTRACT

A free-machining alloy is disclosed containing bismuth and indium. The free-machining constituents act as low melting point compounds for machining and are specially adapted for use in aluminum alloys such as AA6000 series and AA 2000 series alloys. The bismuth and indium are effective replacements for the lead and bismuth addition used previously to improve machinability while providing a high impact energy free machining alloy.

23 Claims, 2 Drawing Sheets

FREE-MACHINING ALUMINUM ALLOY AND METHOD OF USE

FIELD OF THE INVENTION

The present invention is directed to free-machining alloys and, in particular, to free-machining aluminum alloys which contain bismuth and indium.

BACKGROUND ART

Free-machining aluminum alloys are well known in the art. These alloys typically include free-machining constituents such as lead, tin, indium and bismuth for improved machinability. These constituents form low melting point compounds which readily melt or soften due to the friction heat created during machining. Thus, material removal required for the manufacture of complex parts and components is easily facilitated.

During machining, free-machining alloys generate small chips or curls which are easily collected and do not interfere with the machining process. It is essential that these free-machining aluminum alloys form these small chips or curls for proper machining. Formation of long continuous strips or curls is totally unacceptable in machining since the curls or strips may wrap around the work piece or machining tool and disrupt the operation. Poor machinability also affects other machining operations since the operator must attend to a single machining operation and cannot effectively supervise a multiplicity of operations, as is commonly done in practice. AA6061 alloys are generally unacceptable for machining since they form these long continuous curls during machining.

U.S. Pat. Nos. 2,026,457 and 2,026,575 to Kempf et al. disclose free cutting aluminum alloys. Similarly, U.S. Pat. No. 4,005,243 to Baba et al. discloses a freely machinable aluminum alloy.

Other known machinable alloys include AA6262 and AA2011, 2012 and 2111.

While the prior art aluminum alloys provide adequate free machinability, they are not without drawbacks and/or disadvantages. For example, AA6262 contains lead and chips from machining this alloy represent a hazardous waste disposal problem, in addition to the possibility for exposure to fine lead particles during machining.

Prior art alloys containing bismuth, e.g., AA2011 and AA2111, can adversely affect the final mechanical properties of the machined part. Since bismuth has some affinity for magnesium, the bismuth in these alloys has a tendency to combine with the magnesium to prevent or reduce $Mg_2Si$ formation potential for precipitation strengthening. Bismuth also has a poor affinity for tin, and alloys having these two components may not always form the desired low melting point compounds or structures for free machining.

As a solution to the problems identified above, the inventor has proposed free-machining aluminum alloys containing tin and indium as a means to eliminate both lead and bismuth as constituents in free-machining alloys. This alloy system is disclosed in U.S. Pat. No. 5,587,029, titled "Machineable Aluminum Alloys Containing In and Sn and Process for Producing the Same", issued Dec. 24, 1996 which is herein incorporated by reference in its entirety.

Although free-machining alloys containing the aforementioned indium and tin provide excellent machining properties, the levels of indium when combined with a high price for the source indium make the alloys somewhat unattractive from an economical standpoint.

Other free machining alloys suffer from inadequate Charpy V-notch impact strength. For example, AA6020 which has tin and high levels of silicon, instead of the lead and bismuth in A6262, exhibits poor impact properties. Alloys with low impact properties have a tendency to crack when deep drilled.

As such, a need has developed to provide an environmentally friendly free-machining alloy which does not have its final mechanical properties compromised by free-machining constituents therein, has good impact properties and which is even more economically attractive.

In some applications involving hot automotive brake fluid, alloys containing Sn have shown to be extremely poor in corrosion resistance. Hence, this new alloy is also aimed at removing Sn from alloys that require exposure to hot brake fluid.

SUMMARY OF THE INVENTION

Accordingly, it is a first object of the present invention to provide a free-machining aluminum alloy which eliminates lead and its adverse effects on the environment during machining chip disposal.

Another object of the present invention is to provide a free-machining aluminum alloy containing bismuth and indium which has at least comparable free-machining properties as prior art alloys.

Another object of the present invention is to provide an economically attractive free-machining alloy. A still further object of the present invention is to provide a method of machining using a lead free free-machining alloy which utilizes bismuth and indium as a low melting point compound for machinability.

A yet another object of the invention is to provide a free-machining alloy having improved impact properties.

A still further object is to provide an alloy having improved resistance to corrosion when exposed to hot brake fluid.

Other objects and advantages of the present invention will become apparent as a description thereof proceeds.

In satisfaction of the foregoing objects and advantages, the present invention provides an improvement over the prior art free-machining alloys containing low melting point free-machining constituents. According to the invention, an effective amount of bismuth and indium is utilized in these types of alloys as free-machining constituents, i.e., low melting point compounds (eutectics). It should be appreciated that the terms "bismuth" and "tin", as used herein, are not limited to pure elements but also include elements having incidental impurities of the types associated with commercially available alloying elements.

The effective amounts of bismuth and indium can be added to alloy chemistries typical of free-machining alloys such as aluminum-base alloys, e.g., AA6000 or AA2000 series alloys or other alloys, ferrous or non-ferrous. The effective amounts are such that the bismuth and indium form the low melting point compounds in an amount which, when dispersed throughout the alloy shape being machined, generate chips rather than curls or stringers during machining. The free-machining alloying constituents can range, in vol. %, up to 1.0 and, preferably, up to 0.5. The lower limit, in some cases, can be as low as 0.01 vol. %. In other cases, the lower limit may be 0.2 or 0.3 vol. %. While amounts greater than 1.0 vol. % might increase machinability, the improvement in machinability might have an unacceptable impact on alloy properties. Similarly, the lower limit is a function of the desired improvement in machinability. If the amount is too low, there will be an insufficient number or dispersion of the low melting point constituents to have any significant impact on machinability.

Preferably, in terms of weight percent, the amounts of Bi and In are added to a selected alloy so that their respective weight percentages in the selected alloy range between about 0.10 to 1.5 Bi and about 0.01 to 0.30 In.

More preferably, the present invention discloses a free-machining alloy wherein the bismuth ranges between 0.30–1.0 wt. %, and the indium ranges between 0.03 and 0.11 wt. %. In one mode, the bismuth and indium can be provided in a eutectic ratio, i.e., 33 wt. % In-67 wt. % Bi.

In terms of the type of binary alloys, preferred binary alloys for addition to a given base alloy include, in wt. %, 80 Bi- 20 In, 85 Bi-15 In, 90 Bi-10 In, and 95 Bi-5 In. Binary alloys with increasing amounts of indium can also be selected but are not as preferred due to the cost of indium. Indium and bismuth may be added to the molten base alloy as individual elements or as an alloyed constituent (master alloy) in the desired ratio.

The bismuth and indium can be added as substitutes for the free-machining constituents in AA6262 and AA2111 free machining aluminum alloys. In addition, they may be added to other alloys to improve machinability.

BRIEF DESCRIPTION OF THE DRAWINGS

Reference is now made to the drawing of the invention wherein.

DESCRIPTION OF THE PREFERRED EMBODIMENTS

Figure 1:
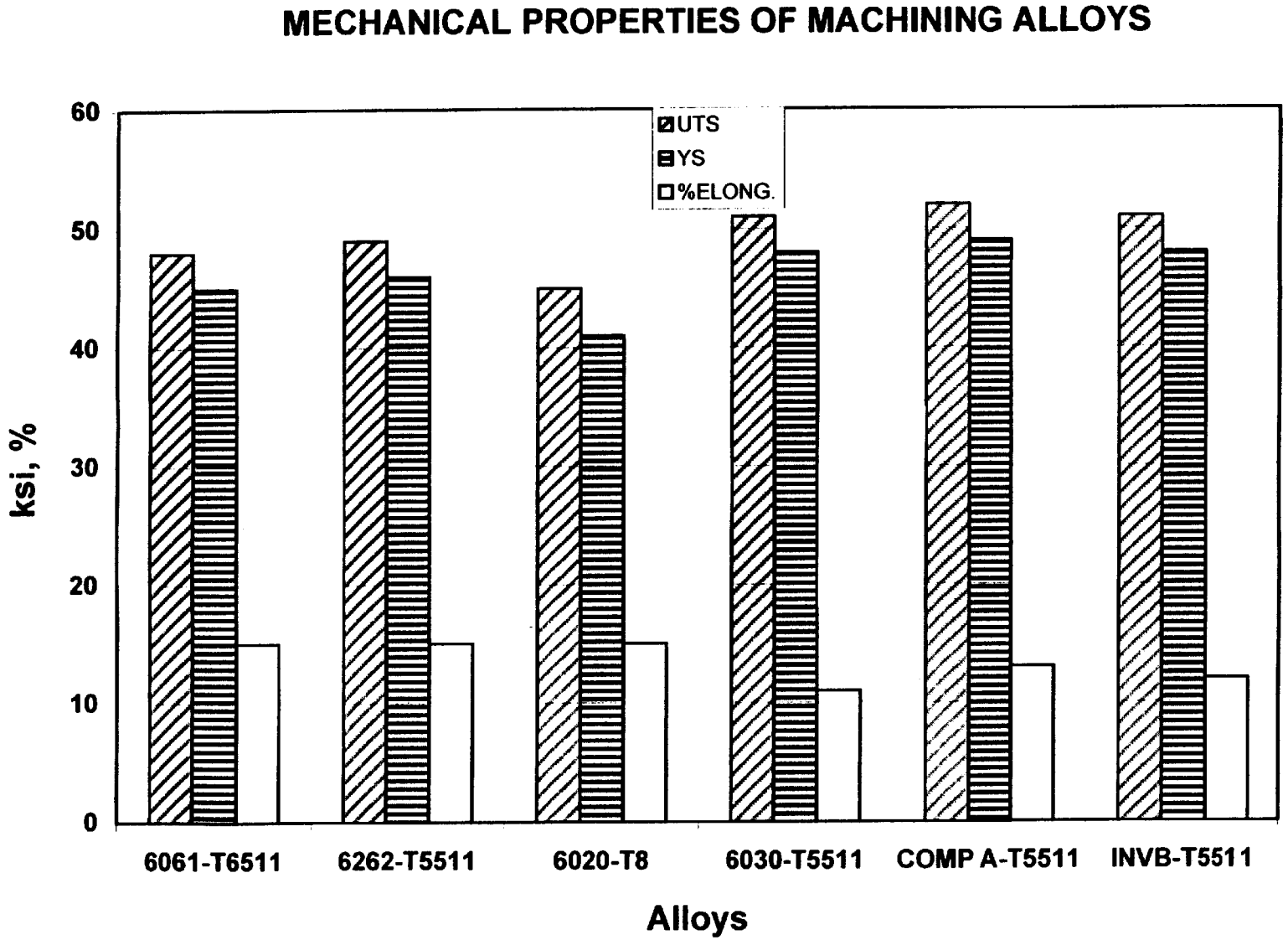
FIG. 1 compares mechanical properties for prior art alloys and the inventive alloy.

The present invention is an improvement over prior art free-machining alloys.

According to the invention, an effective amount of bismuth and indium can be used to provide free machining. Bismuth and indium are principally substituted for the free-machining or low melting point constituents in prior art free-machining alloys, such as lead and bismuth or bismuth and tin.

An effective amount of bismuth and indium is a respective amount of each alloying component that, when combined with the other component, forms a low melting point compound as part of the alloy and results in a free-machining alloy that generates the proper sized machine chips or curls for effective machining. Indium and bismuth are relatively insoluble in the aluminum matrix, and, therefore, are dispersed in the matrix as inclusions, rather than in solid solution.

A binary alloy of bismuth and indium has a eutectic temperature of about 109° C. (228° F.), i.e., 33 wt. % indium and 67 wt. % bismuth. However, lower amounts of indium will still give a range of melting point temperatures. For example, an 85 wt. % bismuth-15 wt. % indium alloy will have some melting between about 109° C. and 200° C. (228° F. and 392° F.). Thus, even with off-eutectic binary Bi-In alloys, melting of the dispersoids will occur (starting at 109° C.–228° F.) to provide the desired free machining qualities. It is believed that the inventive alloy can use any binary bismuth-indium alloy having respective amounts of bismuth and indium up to the eutectic composition of about 67% bismuth-33% indium. It also is potentially possible to use even higher amounts of indium in the binary alloy.

Preferably, the ratios between the amounts of bismuth and indium added, in weight %, fall within the following ranges: bismuth –67 to 99% and indium –1 to 33%, more preferably 85 to 95% bismuth and 5 to 15% indium. As stated above, it is preferred to limit the level of indium so that the binary alloy and the subsequently modified free machining alloy are economically attractive.

The effective amount of bismuth and indium, when added to a standard alloy such as a steel or an aluminum alloy, forms a low melting point compound, or a low melting eutectic in the alloy. With this low melting point compound present in the alloy, a local increase in the alloy temperature due to machining of an article made from the alloy brings the low melting point compound to a soft or liquid state. In this state, the low melting point compound loses its strength thereby facilitating the formation of a chip. The chip can then be easily removed from the machining area without interfering with the machining process. This contrasts with prior art alloys which have a tendency to form long stringers or curls which can interfere with the machining process.

It has been discovered that the use of indium and bismuth as free-machining constituents for an alloy to be machined offers significant improvements over prior art systems using lead-bismuth, bismuth-tin, indium-tin, indium-tin-bismuth and high silicon and tin low melting point constituents. The well-recognized problem with lead-bismuth systems is that a large amount of the lead-bismuth addition is needed to obtain the necessary volume percent in the alloy for free machining. Since lead is extremely dense, large additions are needed which increase the environmental unacceptability of these types of alloys. These systems are also disadvantageous in that the eutectic point of the low melting compound is about 125° C.

Bismuth-tin systems, while being lead-free, do not machine nearly as well as lead-containing systems. These bismuth-tin systems are also disadvantageous in that the eutectic melting point is 140° C. which is even higher than that of the lead-bismuth systems discussed above.

The invention, in one aspect, is an improvement over the bismuth-tin systems in that the addition of indium lowers the melting point. The invention is also an improvement over an AA6020 alloy when the bismuth-indium binary alloy is used with an aluminum base alloy in that the inventive alloy exhibits vastly superior impact properties.

Since the inventive free-machining alloys are lead-free, there is no problem in achieving the necessary volume percent in the article for acceptable machining properties, while still being environmentally friendly. It is believed that when using the bismuth-indium low melting point compound, a volume percent of up to about 1.0% provides acceptable machining capability, preferably 0.1 to 0.5% and more preferably about 0.2 to 0.4%. Of course, the volume percent may vary depending on the alloy system being used in conjunction with the bismuth-indium addition, the machining process being used with the article or articles formed from the alloy, the desired impact on machining properties of the article, and the acceptable change in properties of the alloy associated with the addition.

If a particular binary alloy, e.g., 85Bi-15In, in wt. %, and a volume fraction, e.g. 0.3%, are selected for a particular alloy, one skilled in the art, knowing the density of the elements to be added and that 0.5% volume fraction of a Pb-Bi eutectic in AA6262 equals about 1.0 wt.%, can calculate the amount of bismuth and indium needed to achieve both the binary composition and volume fraction. For example, targeting a 0.5% volume fraction and a 90Bi-10In binary alloy, one would add 91 parts of the 90–10 binary rather than 100 parts of a Pb-Bi eutectic binary, further split as 82 parts bismuth and 9 parts indium to maintain the proper Bi-In ratio. This split could then be reduced proportionately for lower or higher volume fractions, e.g., 0.4% volume fraction or a 20% reduction in the total amount of the binary alloy. Since relating volume fraction to the needed weight percent in a given alloy is within the skill of the artisan, a further detailed description is not deemed necessary for understanding of the invention.

When adding the bismuth and indium to a particular alloy, it is preferred that the thus-formed low melting point binary compound be finely dispersed throughout the alloy article to be machined. Without a fine dispersion or distribution of the binary compound, a machining tool may come into contact with portions of the alloy article being machined that are devoid of the low melting point compound. Machining these areas may result in formation of long stringers or the like rather than chips. The stringers then adversely affect the overall machining process.

When using bismuth and indium free-machining constituents in an aluminum-based alloy which is heat treatable, the appropriate controls can be utilized during the various processing steps used to form the alloys into articles and shapes for machining, e.g., working, quenching, annealing, solution heat treating, aging, etc. Since obtaining a fine distribution or dispersion of free-machining constituents in aluminum and other alloys is well known, a further description of these techniques is not deemed necessary for understanding of the invention.

As stated above, it is believed that the use of a bismuth-indium low melting point compound applies to ferrous and nonferrous alloys. This system is especially adapted for use in heat treatable aluminum alloys such as the AA6000, AA5000, AA7000 and AA2000 series and non-heat treatable aluminum alloys such as AA1000, AA3000 and AA4000 series types Table 1 sets forth, in weight percent, an example of using the bismuth-indium low melting point compound in an AA6000 series aluminum alloy. The maximum amount of indium shown in the "Broader Limits" portion of Table 1, in one embodiment, is limited to 0.30 wt. %. Table 2 shows weight percentages for indium and bismuth in an AA6061 alloy base for different volume fractions of the binary in the AA6061 material.

TABLE 1

| | Broader Limits | Preferred Limits |
|---|---|---|
| Si | 0.40–0.8 | 0.55–0.65 |
| Fe | 0.7 max. | 0.30 max |
| Cu | 0.15–0.40 | 0.17–0.33 |
| Mn | 0.15 max. | 0.10 max. |
| Mg | 0.8–1.2 | 0.9–1.1 |
| Cr | 0.04–0.35 | 0.06–0.12 |
| Zn | 0.25 max. | 0.05 max. |
| Ti | 0.15 max. | 0.05 max. |
| In | 0.01–0.40 | 0.03–0.11 |
| Bi | 0.10–1.5 | 0.30–1.0 |
| Impurities - Total | 0.05 max | 0.05 max. |
| Impurities - total | 0.15 max. | 0.15 max |
| A1 | Balance | Balance |

TABLE 2

| Binary Alloy Type | Volume Fraction in Percent | Wt. % Bi in AA6061 Alloy | Wt. % In In AA6061 Alloy |
|---|---|---|---|
| 85Bi—15In | 0.04 | 0.61 | 0.11 |
| | 0.03 | 0.46 | 0.08 |
| | 0.02 | 0.31 | 0.05 |
| 90Bi—10In | 0.04 | 0.66 | 0.07 |
| | 0.03 | 0.49 | 0.05 |
| | 0.02 | 0.33 | 0.04 |
| 95Bi—51n | 0.05 | 0.88 | 0.05 |
| | 0.04 | 0.70 | 0.04 |
| | 0.03 | 0.53 | 0.03 |
| | 0.02 | 0.35 | 0.02 |
| | 0.01 | 0.18 | 0.01 |

Although an AA6000 series aluminum alloy with a low melting point compound is exemplified in Tables 1 and 2, the weight percentages for In and Bi set forth are believed useful with other aluminum alloys and steels.

As stated above, systems using just bismuth and tin have not exhibited improved machinability. It is believed that the relatively high melting point of a non-eutectic bismuth-tin phase in these systems, as compared to eutectic lead-bismuth systems or indium-tin systems, may be related to the lack of good machinability. It is believed that combining indium with bismuth improves the machinability of the binary-containing alloy significantly as compared to these prior art alloys.

To demonstrate the effective machining properties of the inventive alloy, several different types of machining studies were conducted. Table 3 shows the results of a turning study wherein various types of free machining alloys were compared in terms of peak machining temperatures and size and type of machining pieces. The peak machining temperature is the measured temperature of the article remote from the machining site, as distinguished from the local temperature rise in the area being machined. The alloys tested included AA6061, AA6262, AA6020, X6030, COMP A, i.e., an In-Sn-Bi-containing AA6061 alloy, and the inventive alloy (INV B). The X6030 alloy is an indium -tin containing alloy. The turning study involved rough turning nominal 1" (25.4 mm) diameter rods at a rate of 2000 RPM and a feed rate of 0.020 inches (0.51 mm) per revolution (IPR). Metal removal was 0.400" (10.2 mm) from the diameter with one cut at 4" (101.6 mm) in length. A finish cut was done at 2000 RPM, an IPR of 0.005" (0.127 mm) and 0.025" (0.635 mm) metal removal at a 2" (50.8 mm) cut. Carbide insert tooling was used. As can be seen from Table 3, the inventive alloy produced small chips, the ideal machining debris. In addition, the weight of 20 chips for the inventive alloy was low, thereby substantiating the small size of the machining debris. The peak temperature for INV B was also lower than the other free machining alloys, indicating good machining capability. In contrast, known free machining alloys such as AA6262 and AA6020 produced curls. AA6061 was totally unacceptable as a free machining alloy.

In a drilling study wherein a ¼" (6.35 mm) hole was drilled in a 1" (25.4 m) rod, INV B exhibited slight to no chatter and small machining chips. In contrast, AA6262 exhibited light chatter at drilling onset and produced mixed chips and strings and AA6020 had light chatter and small to medium chips.

TABLE 3

| ALLOY DESIGNATION | PEAK TEMP ° F. (° C.) | COMMENTS | WEIGHT OF 20 CHIPS IN GRAMS |
|---|---|---|---|
| X6030 | 113.8 (45° C.) | short/med curls | 1.30 |
| 6020-T8 | 105.3 (41° C.) | long strings | 1.16 |
| 6262-T9 | 104.3 (40° C.) | small curls | 1.34 |
| 6061-T6511 | 142.1 (61° C.) | single string | — |
| COMP A | 105.4 (41° C.) | long chips | 1.43 |
| INV B | 110.6 (44° C.) | small chips | 1.28 |

| | Compositions of Alloy Designations in Wt. %. | | | | | | | | | | | |
|---|---|---|---|---|---|---|---|---|---|---|---|---|
| Alloy | Si | Fe | Cu | Mn | Mg | Cr | Zn | Ti | Sn | Bi | Pb | In |
| 6020 | 0.90 | 0.33 | 0.65 | 0.03 | 0.75 | 0.06 | 0.01 | 0.02 | 0.97 | — | — | — |
| 6262-T6511 | 0.57 | 0.30 | 0.28 | 0.11 | 0.89 | 0.10 | 0.02 | 0.02 | — | 0.47 | 0.45 | — |
| 6262-T9 | 0.55 | 0.52 | 0.30 | 0.13 | 0.98 | 0.10 | <0.01 | 0.02 | — | 0.41 | 0.46 | — |
| 6061-T6511 | 0.62 | 0.32 | 0.23 | 0.03 | 0.84 | 0.13 | 0.06 | 0.04 | — | — | — | — |
| COMPA-T5511 | 0.66 | 0.22 | 0.22 | <0.01 | 0.95 | 0.10 | 0.03 | <0.01 | 0.26 | 0.27 | — | 0.08 |
| INVB-T5511 | 0.64 | 0.27 | 0.20 | <0.01 | 0.92 | 0.10 | <0.01 | <0.01 | — | 0.68 | — | 0.10 |

The inventive alloy does not sacrifice mechanical properties at the expense of improved machinability. The levels of ultimate tensile strength, yield strength, and elongation are equivalent or better than the prior art alloys noted above. FIG. 1 compares the mechanical properties of the alloys listed above and shows that the inventive alloy is at least as good as the prior art alloys. More particularly, the INV B-T5511 alloy gives equivalent mechanical properties as the other free machining alloys such as COMP A and the X6030 alloy.

Figure 2:
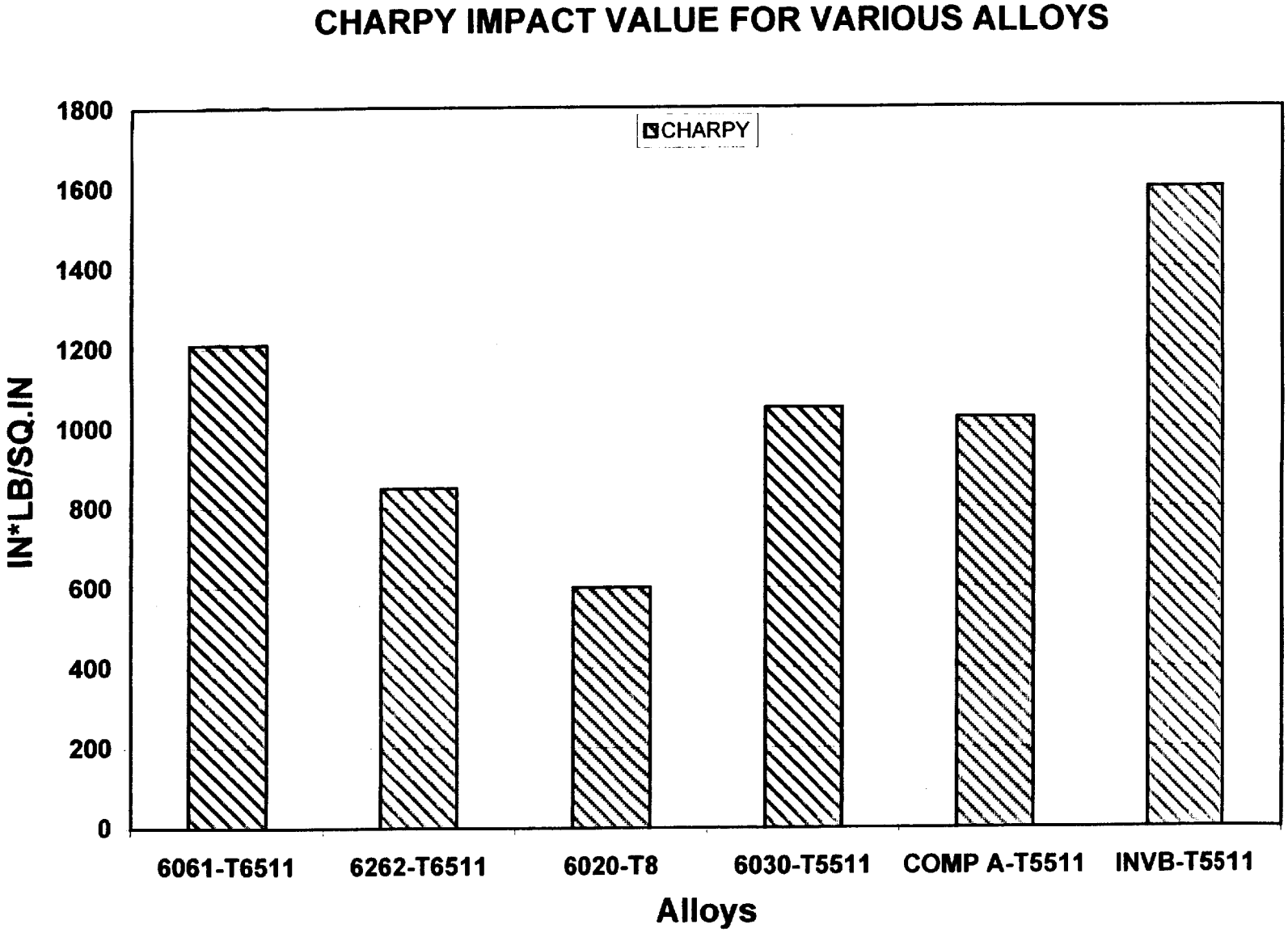
FIG. 2 compares impact energies for prior art alloys and if the inventive alloy.

Quite surprisingly though, the inventive alloy provides significant improvements in Charpy V-notch impact values. Referring to the FIG. 2, significant improvements are seen for INV B as compared to the other free machining alloys, particularly AA6020, and even better than AA6061. Thus, assuming that mechanical properties are equivalent between the various alloys, applications requiring good impact properties are best served by using INV B rather than other known alloys.

In the inventive method, an article or shape is made of an alloy containing the free-machining constituents, bismuth and indium. The alloy can be made using any conventional techniques known to one of ordinary skill in the art, including but not limited to rolling, extruding, forging and combinations thereof. Similarly, conventional methodology can be used to form the alloy into a desired shape for machining. Once the alloy is made into a shape, e.g., a bar, rod or other work piece with the free-machining constituents as components thereof, the work piece can then be machined without interference from the machining debris since the debris is basically in the form of machining chips if rather than mostly long curls, stringers or other elongated pieces. The machining can be any type known in the art.

As mentioned above, it is believed that the bismuth and indium alloy constituents can also be used in free-machining alloy steels. These steels include both austenitic and ferritic stainless steels as well as low carbon, medium carbon and alloy grade steels.

In summary, the present invention provides for the addition of a low melting compound to conventional alloys, such as AA 2000 (copper is principal alloying element) and AA6000 (alloys contain silicon and magnesium in appropriate proportions to form magnesium silicide) series alloys to improve their machinability. While using prior art low melting point compounds such as indium and tin or indium, tin and bismuth improves machinability, as does the use of a lead and bismuth compound, these compounds are not without their disadvantages. The addition of lead is unattractive because of environmental issues. When the cost of indium is high, its use with the addition of tin or tin and bismuth becomes economically unattractive.

As such, an invention has been disclosed in terms of preferred embodiments thereof which fulfill each and every one of the objects of the present invention as set forth above and provide a new and improved free-machining alloy and a method of use.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A free machining lead free aluminum alloy comprising an aluminum alloy including a low melting point eutectic compound uniformly distributed in the alloy that consists essentially of indium and bismuth in a volume percent of said lead free aluminum alloy, said compound softening or melting during machining to generate small chip-like machining debris, wherein the bismuth amount in weight percent ranges between 0.1 and 1.5%.

2. The alloy of claim 1 wherein the aluminum alloy is one of an AA6000, AA5000, AA7000, AA1000, AA3000, AA4000, AA8000 or AA2000 series alloy.

3. The alloy of claim 1 wherein the volume percent is less than 1.0.

4. The alloy of claim 1 wherein the low melting point compound has a melting point ranging between about 109° C. and up to about 270° C.

5. The alloy of claim 1 having a composition consisting essentially of, in weight percent:

0.4 to 0.8 Si;

0.15 to 0.4 Cu;

0.8 to 1.2 Mg;

0.04 to 0.35 Cr;

0.01 to 0.4 In;

up to 0.7 Fe;

up to 0.15 Mn;

up to 0.25 Zn;

up to 0.15 Ti;

with the balance aluminum and incidental impurities.

6. The alloy of claim 5 wherein the Bi ranges between 0.30 and 1.0 and the In ranges between 0.03 and 0.11.

7. The alloy of claim 5 wherein the Si ranges between 0.55 and 0.65, the Cu ranges between 0.17 and 0.33, and the Cr ranges between 0.06 and 0.12.

8. The alloy of claim 7 wherein the Bi ranges between 0.30 and 1.0 and the In ranges between 0.03 and 0.11.

9. The alloy of claim 1 wherein the In ranges between 0.01 and 0.30 wt. % of said lead free aluminum alloy.

10. A free machining lead free aluminum alloy including a low melting point eutectic compound, wherein the low melting point compound consists essentially of indium and bismuth in a volume percent of said lead free alloy, which during machining of an article formed from the lead free alloy softens or melts thereby generating small chip-like machining debris, wherein the bismuth amount in weight percent ranges between 0.1 and 1.5%.

11. The alloy of claim 10 wherein the In ranges between 0.01 and 0.30 wt. % of the free machining lead free alloy.

12. The alloy of claim 11 wherein the bismuth ranges between 0.30 and 1.0 and the indium ranges between 0.03 and 0.11.

13. A method of machining a work piece and generating fine machining chips comprising:

providing a work piece consisting of the alloy of claim 1; and machining said work piece to a desired shape, said machining generating said fine machining chips.

14. The method of claim 13 wherein said alloy is a lead free aluminum alloy.

15. The method of claim 13 wherein the lead free alloy is one of a lead free AA6000 and a lead free AA2000 series alloy.

16. The method of claim 13 wherein the indium ranges between 0.01 and 0.30 wt. % and the bismuth ranges between 0.10 and 1.50.

17. The method of claim 13 wherein the indium ranges between 0.03 and 0.11 and the bismuth ranges between 0.30 and 1.0.

18. The method of claim 13 wherein the alloy has a composition consisting essentially of, in weight percent:

0.4 to 0.8 Si;

0.15 to 0.4 Cu;

0.8 to 1.2 Mg;

0.04 to 0.35 Cr;

0.1 to 0.30 In;

0.1 to 1.5 Bi;

up to 0.7 Fe;

up to 0.15 Mn;

up to 0.25 Zn;

up to 0.15 Ti;

with the balance aluminum and incidental impurities.

19. The method of claim 18 wherein the bismuth ranges between 0.30 and 1.00 and the indium ranges between 0.03 and 0.11.

20. The method of claim 18 wherein the Si ranges between 0.55 and 0.65, the Cu ranges between 0.17 and 0.33, and the Cr ranges between 0.06 and 0.12.

21. The method of claim 13 wherein the work piece is provided as an extruded aluminum article.

22. The method of claim 13 wherein the work piece is provided as a rolled aluminum article.

23. The method of claim 13 wherein the work piece is provided as a forged aluminum article.

* * * * *